US006196938B1

(12) United States Patent
Wiedner

(10) Patent No.: US 6,196,938 B1
(45) Date of Patent: Mar. 6, 2001

(54) REMOVABLE BASKETBALL BACKBOARD COVER

(76) Inventor: Mark C. Wiedner, 738 Brentwood Ct., Glen Ellyn, IL (US) 60137

( * ) Notice: Subject to any disclaimer, the term of this patent is extended or adjusted under 35 U.S.C. 154(b) by 0 days.

(21) Appl. No.: 08/198,443

(22) Filed: Feb. 18, 1994

(51) Int. Cl.[7] ..... A63B 63/00

(52) U.S. Cl. ..... 473/476; 473/481; 473/504

(58) Field of Search ..... 273/1.5 RA; 40/624, 40/603, 611; 150/154–168; 473/476, 479, 481, 485, 504

(56) References Cited

U.S. PATENT DOCUMENTS

| | | | | |
|---|---|---|---|---|
| 663,306 | * | 12/1900 | Tompkins | 150/166 |
| 2,048,461 | * | 7/1936 | Mosgoffian | 150/166 |
| 2,052,771 | * | 9/1936 | Johnson | 40/611 X |
| 2,132,799 | * | 10/1938 | Ostrander | 40/611 |
| 2,434,784 | * | 1/1948 | Bardin | 150/157 X |
| 2,440,891 | | 5/1948 | Bockhold . | |
| 2,517,463 | * | 8/1950 | Cobb | 273/1.5 R |
| 2,652,875 | * | 9/1953 | Puste | 150/154 X |
| 2,704,563 | * | 3/1955 | Henrich | 150/159 |
| 2,727,253 | | 12/1955 | Tomsic . | |
| 2,764,765 | * | 10/1956 | Woodruff, Sr. | 150/166 X |
| 3,622,155 | * | 11/1971 | Hirsch | 273/1.5 R |
| 4,330,101 | | 5/1982 | Andersen . | |
| 4,478,415 | | 10/1984 | Shaffer et al. . | |
| 4,492,049 | * | 1/1985 | Gaylor | 40/624 |
| 4,944,971 | * | 7/1990 | McLaughlin | 150/154 X |
| 4,970,744 | | 11/1990 | Davis . | |
| 4,993,547 | | 2/1991 | Pallasch et al. . | |
| 5,018,564 | * | 5/1991 | Anglin et al. | 150/167 |
| 5,020,177 | | 6/1991 | Etherington . | |
| 5,046,207 | | 9/1991 | Chamberlain . | |
| 5,120,054 | | 6/1992 | Wetzel . | |
| 5,195,742 | | 3/1993 | Bailey . | |
| 5,224,699 | * | 7/1993 | Zaruba | 273/1.5 R |

OTHER PUBLICATIONS

David G. Rodriguez, Official Gazette dated Jan. 25, 1994, Filed Nov. 19, 1992, U.S. Patent No. 5,280,904.

* cited by examiner

*Primary Examiner*—Jeanette Chapman
*Assistant Examiner*—M. Chambers
(74) *Attorney, Agent, or Firm*—Brinks Hofer Gilson & Lione

(57) ABSTRACT

A removable basketball backboard cover adapted to fit on a basketball backboard. The cover comprises a central portion and a leading edge portion. The central portion is adapted to extend across a front face of a basketball backboard and has an opening through which a rim on the front face of the backboard projects. The leading edge portion of the removable cover is adapted to extend across a portion of the back face of the backboard. The central portion of the removable cover preferably displays indicia such as advertising or other promotional material.

14 Claims, 5 Drawing Sheets

REMOVABLE BASKETBALL BACKBOARD COVER

FIELD OF THE INVENTION

The present invention relates to basketball backboards and, more specifically, to a removable basketball backboard cover.

BACKGROUND OF THE INVENTION

It is known to provide basketball backboards, whether of regulation size or otherwise, with advertising or other indicia painted or permanently affixed on the backboard surface. However, such available methods of displaying advertising or other indicia present certain problems. For example, where it is desired to change the advertising or other indicia, the backboard must either be re-painted or replaced in its entirety with a new backboard having the desired advertising or other indicia. As one can appreciate, the need for re-painting or replacing the backboard every time it is desired to change the advertising or other indicia displayed on the backboard can be prohibitively expensive and time consuming.

Additionally, there is a great demand for advertising space at college or professional basketball games. A potentially premium location or displaying advertising or other indicia are the basketball backboards. However, permanently affixing advertising or other indicia on the backboard is unsatisfactory because the advertising or other indicia could be distracting to the players during the game, or unacceptable to the governing body. Moreover, advertising or other indicia affixed to the backboard could also obstruct the view of spectators located behind the basketball backboards. Thus, it would be desirable if advertising or other indicia could be displayed on the backboard before and after the game, but quickly and easily removed from the backboard just prior to the game.

Thus a need exists in the art for a means of displaying advertising or other indicia on a basketball backboard wherein the advertising or other indicia can be removed or changed realatively quickly, inexpensively, and without damage to the backboard.

Moreover, in addition to advertising, it would be desirable to display other indicia such as, for example, university, college, or other school insignias or logos; corporate insignias or logos (such as real estate companies, athletic equipment, apparel or shoe manufacturers; insurance companies; beverage companies, etc.); and professional sports team insignias or logos. Additional examples of suitable indicia include holiday insignias or decorative insignias, which are particularly well-suited for homeowner backboards.

There is yet another need in the basketball backboard art. Basketball backboards are oftentimes used and stored in outdoor environments, as, for example, in playgrounds, mounted on a pole adjacent a driveway, or mounted on the roof above a garage. Such backboards are usually made from inexpensive rigid materials such as plywood. However, in outdoor environments, basketball backboards may suffer from increased wear when subject to outdoor elements such as rain, sleet, snow, freezing temperatures, etc. Thus, there is a need in the art for a means of protecting basketball backboards that are mounted in an outdoor environment from the outdoor elements.

The present invention addresses all of the above-discussed needs.

SUMMARY OF THE INVENTION

The present invention is directed to a removable basketball backboard cover. The removable cover is adapted to fit on a basketball backboard. The cover comprises a central portion and a leading edge portion. The central portion of the cover is adapted to extend across a front face of the backboard and has an opening adapted to permit a rim attached to the front face of the backboard to project therethrough. The leading edge portion of the cover is adapted to extend across at least a portion of the back face of the backboard.

Preferably, the central portion of the removable cover will display indicia, such as advertising, holiday greetings, decorative displays, team logos, etc.

BRIEF DESCRIPTION OF THE DRAWINGS

FIG. 2 *b* is a front view of the pinch cinches attached to the drawstring in FIG. 2 in a configuration adapted for pulling through the drawstring in the process of snugly fitting the cover on the backboard.

DETAILED DESCRIPTION OF THE PRESENTLY PREFERRED EMBODIMENTS OF THE INVENTION

As those skilled in the art will appreciate, the removable backboard cover of the present invention may be adapted for use with any and all types of basketball backboards, regardless of size, shape, or material of construction. Thus, the removable covers of the present invention may be adapted for use with regulation-sized backboards, undersized backboards for small children or oversized backboards. Generally, basketball backboards are formed from rigid materials such as plywood, fiberglass, metal, composition board and the like. Basketball backboards may be of any shape, but are usually rectangular or fan-shaped. Basketball backboards usually have mounting holes to permit attachment of the backboard to an upright support structure with brackets. Examples of basketball backboards suitable for use in the present invention are disclosed in U.S. Pat. Nos. 4,478,415 and 5,120,054, which are incorporated herein by reference.

Figures 1, 6:
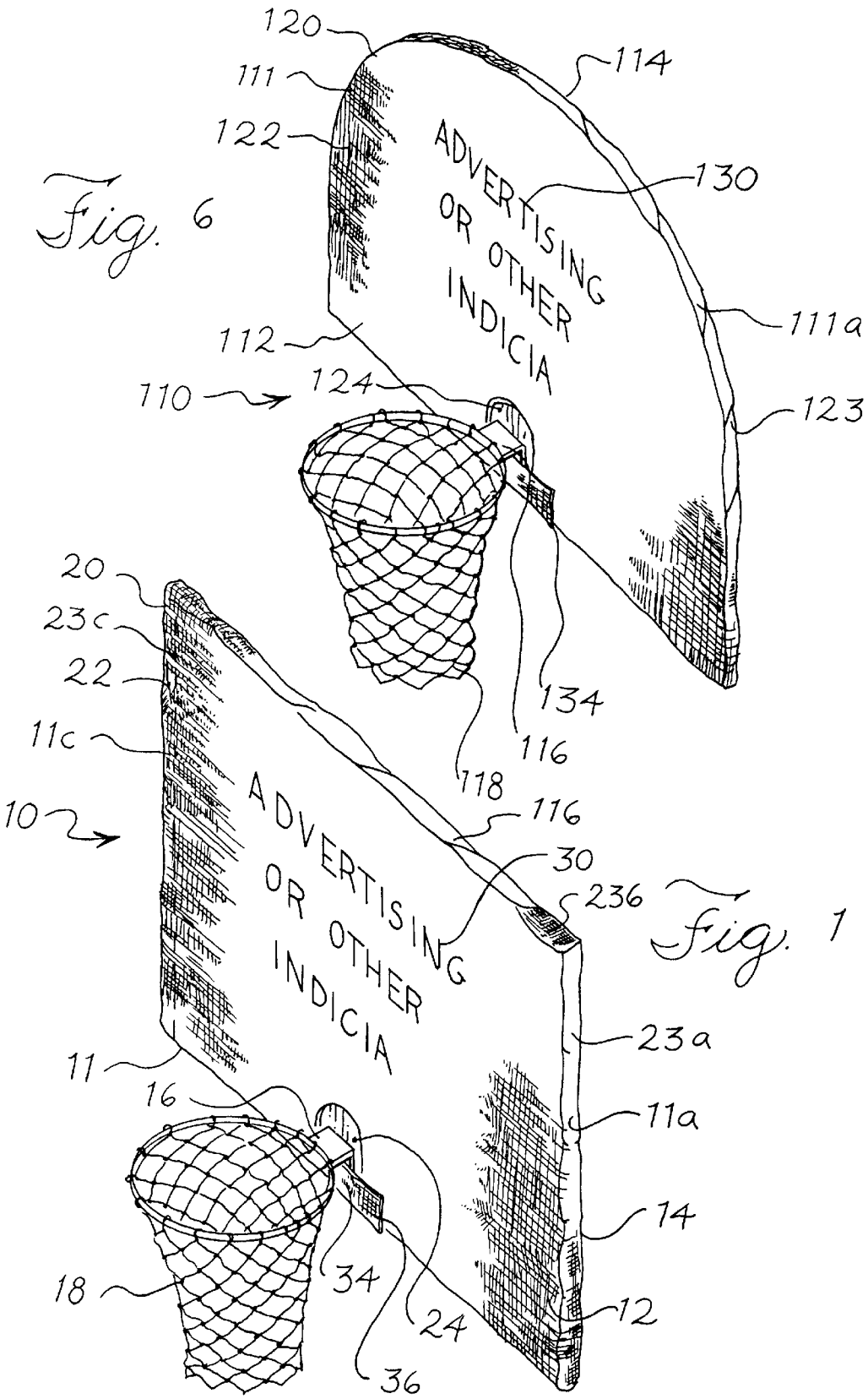
FIG. 1 is a perspective front view of a basketball backboard and removable backboard cover combination in accordance with one embodiment of the invention.
FIG. 6 is a perspective front view of a fan-shaped basketball backboard and removable backboard cover combination according to another embodiment of the invention.

Referring now to the drawings, FIG. 1 illustrates a basketball backboard and removable backboard cover combination 10 according to one embodiment of the present invention. A backboard 11 is provided with a front face 12 and back face 14 (not shown in FIG. 1). A rim 16 is attached to, and projects from, the front face 12. Preferably, a net 18 hangs from the rim 16. Removably mounted on the backboard 11 is a removable cover 20. By removable, it is meant that the cover can be removed from the backboard without damaging the backboard. The removable cover 20 is provided with a central portion 22, which extends across the front face 12 of the backboard 11. The central portion 22 of the cover 20 is further provided with an opening 24 through which the rim 16 projects. Preferably, the cover 20 will further comprise adjacent peripheral edge portions 23*a–c*, which extend across at least a portion of peripheral edges 11*a–c* of backboard 11.

In a preferred embodiment of the present invention, the central portion 22 of the cover 20 will display indicia 30 such as advertising or other promotional material. However, the present invention is not limited to advertising as the indicia 30. For example, the present invention contemplates at least the following indicia: university, college, or other school insignias or logos; corporate insignias or logos (e.g., real estate companies; athletic equipment, apparel or shoe manufacturers; insurance companies; beverage companies; etc.); and professional sports team insignias or logos. Additional examples of suitable indicia include holiday insignias or decorative insignias, which are particularly well-suited for homeowner backboards. As those skilled in the art will appreciate, the types of indicia suitable for display on the central portion 22 of cover 20 are virtually limitless.

Figure 2:
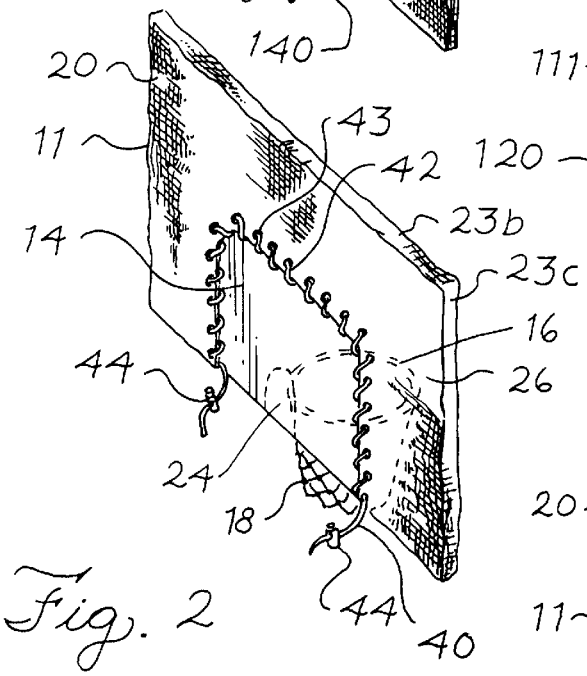
FIG. 2 is a perspective back view of a preferred aspect of the basketball backboard and removable backboard cover combination illustrated in FIG. 1.

As illustrated in FIG. 2, in one aspect of the invention the cover 20 is further provided with a leading edge portion 26, which extends across at least a portion of the back face 14 of the backboard 11. The leading edge portion 26 of cover 20 is provided with a series of openings 42 through which a drawstring 40 is threaded. The perimeter of each opening 42 is preferably bordered by a metal washer 43. Preferably, the drawstring is further provided with pinch cinches 44, which are adapted for snugly fitting the removable cover 20 on the backboard 11.

Figure 2A:
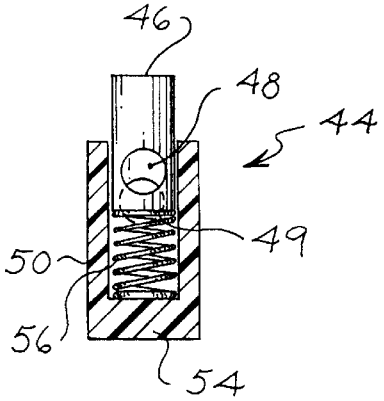
FIG. 2*a* is a front cut-away view of the pinch cinches attached to the drawstring in FIG. 2.
Figure 2B:
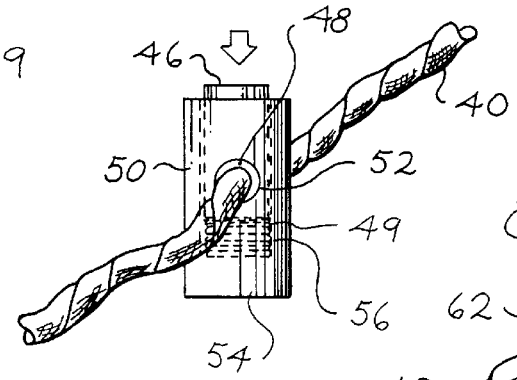
FIG. 2*c* is a front view of the pinch cinches attached to the drawstring in FIG. 2 in its configuration when the backboard cover is snugly fit on the backboard.
Figure 2C:
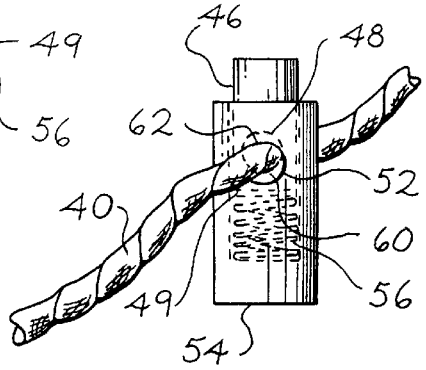

As shown in FIGS. 2*a–c*, the pinch cinches 44 comprise a head 46 with an opening 48 adapted to receive drawstring 40. The head 46 further comprises an extension 49, which engages spring 56. The pinch cinch further comprises a housing 50 having an opening 52 adapted to receive the drawstring 40. The housing 50 contains a base 54, which engages spring 56. Preferably, spring 56 is a helical compression spring. As illustrated in FIG. 2*b*, downward pressure is applied to head 46 to compress spring 56 and align opening 48 of the head 46 with opening 52 of housing 50. While maintaining downward pressure on head 46, the drawstring 40 is threaded through openings 48 and 52. In this manner, pinch cinch 44 can be moved along drawstring 40. After moving pinch cinch 44 along the drawstring 40, the downward pressure is removed from head 46 which permits spring 56 to bias head 46 upwards. As shown in FIG. 2*c*, when the downward pressure is removed from head 46, openings 48 and 52 are no longer perfectly aligned. Drawstring 40 is secured between the upper perimeter portion 62 of opening 52 and lower perimeter portion 60 of opening 48.

Thus, with reference to FIG. 2, drawstring 40 can be pulled through pinch cinches 44 to decrease the length of drawstring 40 along the leading edge portion 26 of cover 20. The cover 20 can be snugly fit on the backboard 11 by abutting pinch cinches 44 up against the leading edge portion 26 of the cover 20 and manually pulling the terminal ends of the drawstring 40 through the pinch cinches 44 until it is difficult to pull further portions of drawstring 40 through pinch cinches 44. In this fashion the cover 20 is snugly fit on the backboard and the central portion 22 of cover 20 will be taut across the front face 12 of the backboard 11. This will permit the indicia 30 to be clearly displayed across the front face 12 of the backboard 11. Moreover, if the central portion 22 of cover 20 is sufficiently taut, the cover 20 may optionally remain on backboard 11 during play.

Although snugly fit, the cover 20 may nonetheless be easily removed from the backboard 11 without damaging the backboard. Thus, the cover 20 is removed from backboard 11 merely by pulling pinch cinches 44 away from the leading edge portion 26 of the cover 20 and relaxing the tension on drawstring 40. In this fashion, the portion of drawstring 40 along the leading edge portion 26 of the cover 20 is increased, which aids in easily removing the cover 20 from backboard 11.

The dimensions of cover 20 are determined by several factors such as the material from which the cover 20 is made, the dimensions of the basketball backboard 11, and the space required to display the indicia 30. For example, if the cover 20 is made from an elastic material, the dimensions of the cover when not mounted on the backboard 11 may be slightly less than the dimensions of the backboard. Thus, the dimensions of the central portion 22 and the leading edge portion 26 may be less than the dimensions of the front face 12 and back face 14, respectively, of the backboard 11. The cover 20 can then be stretched during mounting over the backboard to provide a snug fit of the cover 20 to the backboard 11. The result is that the central portion 22 of the cover 20 will be taut across the front face 12 of the backboard 11. If sufficiently taut, the cover 20 can remain on the backboard during use with minimal effect on the action of the backboard 11.

Conversely, if the cover 20 is made from a non-elastic material, the cover 20 will be dimensioned to generally conform with the dimensions of the backboard for a snug fit or, if a loose fit is desired, the cover 20 will be dimensioned such that its central portion 22 and/or leading edge portion 26 are larger than the dimensions of the backboard front face 12 and back face 14, respectively.

The cover 20 may be made from any suitable material. The cover may be made from, for example, nylon, lycra, cotton or any combination thereof. As those skilled in the art will appreciate, the present invention is not limited to any specific material constituent of the removable cover, and that a variety of materials may be suitably used in the present invention. Furthermore, the cover 20 may be manufactured in colors matching those of, for example, a school, university, business organization, or charity.

As shown in FIG. 1, however, the dimensions of the central portion 22 of the cover 20 are preferably adapted to substantially match the dimensions of the front face 12 of the backboard 11 so that the central portion 22 of the cover 20 extends across the front face 12 of the backboard 11.

As shown in FIG. 2, the dimensions of the leading edge 26 of the cover 20 are determined by the dimensions of the back face 14 of the backboard 11 and by the amount or the extent to which it is desired to cover the back face 14 of the backboard 11. The extent to which it is desired to cover the back face 14 of the backboard 11, and thus the dimensions of the leading edge 26, is determined based on various considerations.

Thus, in outdoor applications where it is desired to protect the basketball backboard from the elements, it is preferable to dimension the leading edge portion 26, and the central portion 22, of the cover 20 so that the entire front face 12 and back face 14 of the backboard 11 are covered by the cover 20, and thus protected from the elements. Conversely, in indoor applications there is no need to protect the backboard 11 from the elements. Thus, only a portion of the back face 14 of the backboard 11 needs to be covered by the leading edge portion 26 of the cover 20 as shown in FIG. 2.

As shown in FIG. 1, in a preferred embodiment of the present invention, the cover 20 is provided with a sleeve 34 positioned adjacent the opening 24. The sleeve 34 is provided with a means for detachably securing the sleeve 34 to the central portion 22 of the cover 20. The sleeve 34 is preferably provided with a hook and loop securing means such as VELCRO strip arrangement 36 for detachably securing the sleeve 34 to the central portion 22 of the cover 20. As shown in greater detail in FIG. 9, the VELCRO strip arrangement may comprise a strip of minute nylon hooks 136*a* mounted on sleeve 134 that penetrate and catch in a closely woven strip of nylon hoops 136*b* mounted on central face 122 of cover 120. Of course, as those skilled in the art will appreciate, that arrangement may be reversed so that the nylon hoops 136*b* are positioned on sleeve 134*a* and nylon hooks 136*a* are positioned on central face 122 of the cover 120.

Figure 9:
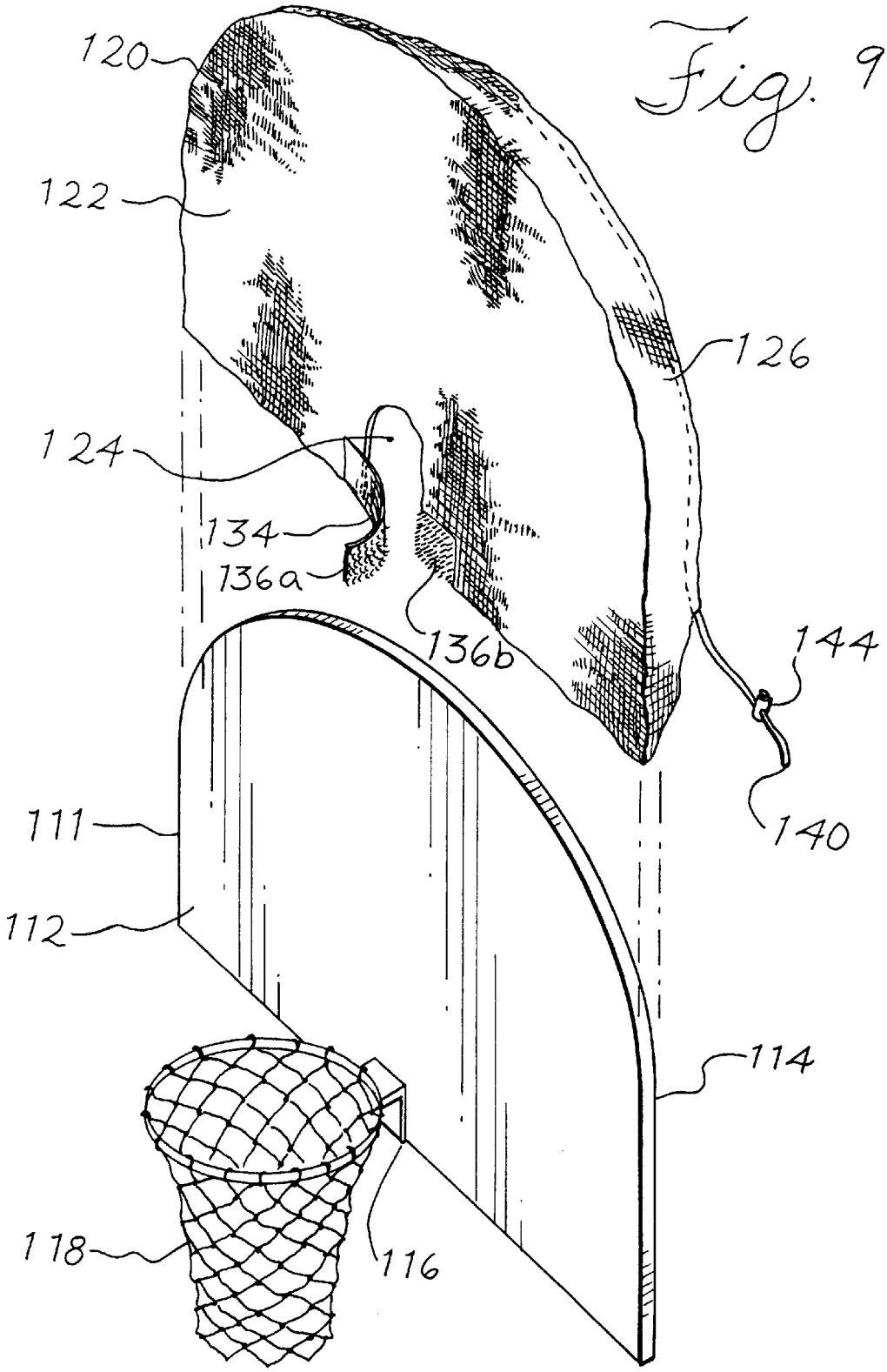
FIG. 9 is a perspective front view of a removable backboard cover according to one embodiment of the present invention in the process of being mounted on a fan-shaped basketball backboard.

As further illustrated in FIG. 9, the sleeve 134 is preferably in its detached or open condition for conveniently mounting the cover 120 on the backboard 111. However, as illustrated in FIG. 1, once the cover 20 is mounted over the backboard 11, the sleeve 34 is placed in its attached or closed position by sealing the VELCRO strip arrangement 36.

As those skilled in the art will appreciate, the attaching means for sleeve 34 is not limited to the VELCRO arrangement 36 and 136*a* and 136*b* shown in FIGS. 1 and 9, respectively, but rather the present invention contemplates any type of attaching or securing means for sleeve 34. Thus, for example, a complimentary snap arrangement may be provided. According to such an arrangement the sleeve 34 is provided with one or more snaps (not shown) and the front face 22 of cover 20 is provided with cooperating snap receptacles (not shown) adapted to mateably receive the snaps on sleeve 34. Conversely, front face 22 of the cover 20 may be provided with one or more snaps (not shown) and sleeve 34 is provided with one or more cooperating snap receptacles (not shown) adapted to mateably receive the snaps on front face 22 of the cover 20. Similarly, a button arrangement may be provided for detachably securing sleeve 34 to front face 22 of cover 20.

Figure 3:
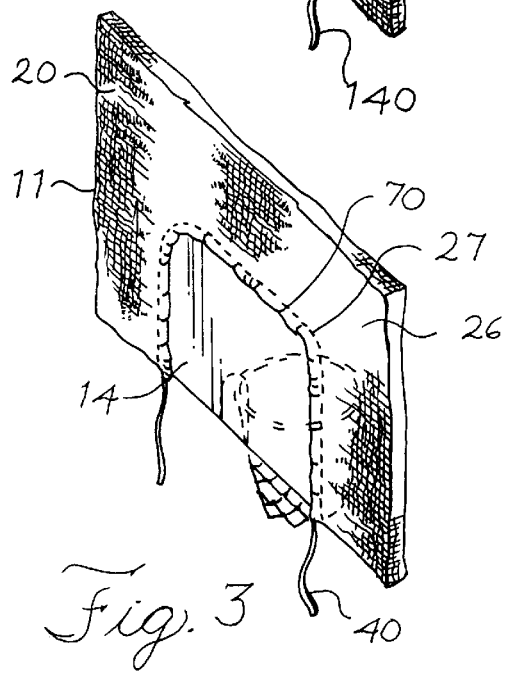
FIG. 3 is a perspective back view of a basketball backboard and removable backboard cover according to another embodiment of the invention.

FIG. 3 illustrates an alternate embodiment of the present invention wherein the leading edge portion 26 of the cover 20 is provided with a hollow channel 70 in which the drawstring 40 sits. Channel 70 may be formed simply by folding over and hemming a free edge 27 of the leading edge portion 26 so as to form a channel 70. It will be appreciated by those skilled in the art that the drawstring 40 can be inserted into channel 70 after its formation or the drawstring 40 can be positioned prior to the sewing of the channel 70. Although not shown, pinch cinches 44 as illustrated in FIGS. 2 and 2*a–c* may be provided for drawstring 40 in the embodiment disclosed in FIG 3. However, in the alternate embodiment illustrated in FIG. 3, the cover 20 is fittingly attached on the backboard 11 as follows. Drawstring 40 is manually pulled at both ends so as to reduce the length of that portion of drawstring 40 located within channel 70. Then a knot (not shown) is tied using the loose ends of the drawstring 40 in order to releasably fix the length of drawstring 40 in channel 70. As those skilled in the art will appreciate, the tautness of the central portion 22 of cover 20 across the front face 12 of backboard 11 can be varied by varying the length of drawstring 40 in channel 70.

The drawstring 40 may be made from any sutiable material. The drawstring 40 may be elastic or inelastic. In a presently preferred embodiment, the drawstring is made from a relatively inelastic rope material. However, it is also contemplated that the drawstring may be made from an elastic material that is capable of stretching to a length of up to several times its original length and still display a tendency to return to its original length.

Figure 4:
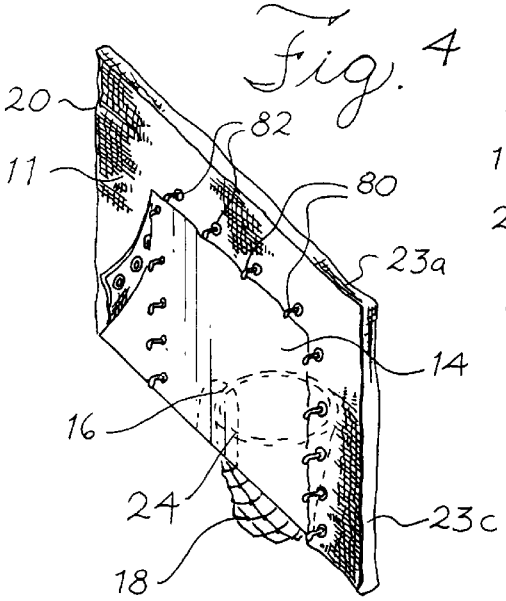
FIG. 4 is a perspective back view of a basketball backboard and removable backboard cover according to one embodiment of the invention showing a hook arrangement.

FIG. 4 illustrates yet another embodiment of the present invention. In this embodiment, the back face 14 of backboard 11 is provided with a series of hooks 80. The hooks 80 are adapted to mateably receive a series of openings 82 positioned along the leading edge portion 26 of cover 20. The perimeter of each opening 82 is preferably bordered by a metal washer 83.

Figure 5:
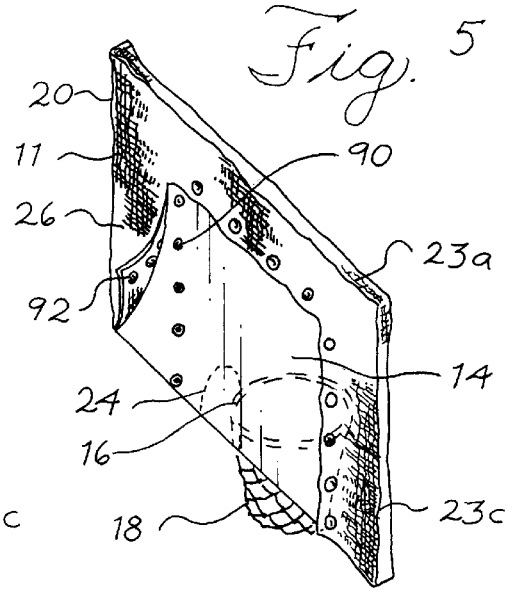
FIG. 5 is a perspective back view of a basketball backboard and removable backboard cover combination according to one embodiment of the invention showing a complimentary snap arrangement.

FIG. 5 illustrates yet another embodiment of the present invention. In this embodiment, back face 14 of backboard 11 is provided with a series of snap receptacles 90. The snap receptacles are adapted to mateably receive a series of cooperating snaps 92 positioned along the leading edge portion 26 of cover 20. Thus, the cover 20 can be easily snapped on backboard 11. Of course, as those skilled in the art will appreciate, the cooperating snap arrangement may be reversed so that snap receptacles 90 are positioned along the leading edge portion 26 of cover 20 and the cooperating snaps 92 are positioned on the back face 14 of backboard 11.

Figure 7:
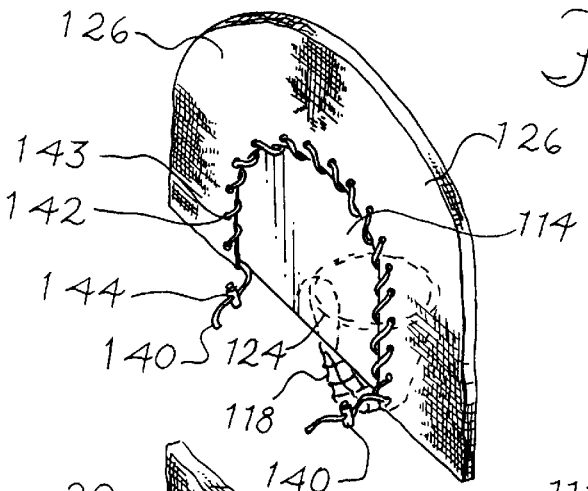
FIG. 7 is a perspective back view of a fan-shaped basketball backboard and removable backboard cover combination according to another embodiment of the invention.
Figure 8:
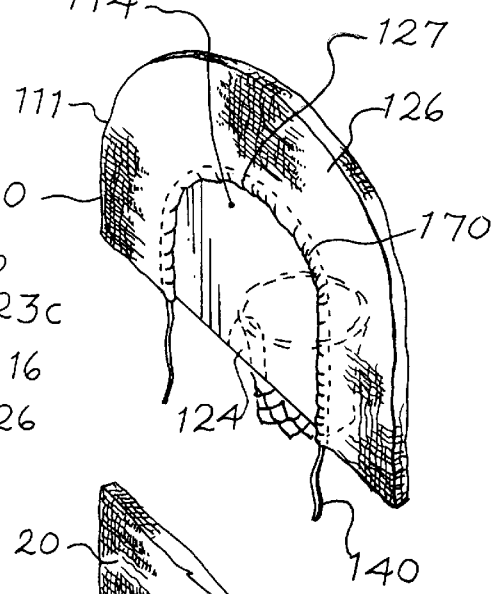
FIG. 8 is a perspective back view of a fan-shaped basketball backboard and removable backboard cover combination according to another embodiment of the invention.

FIGS. 6–8 illustrate yet other embodiments of the present invention adapted for use with a fan-shaped backboard. The embodiments disclosed in FIGS. 6–8 are quite similar to the embodiments of the invention disclosed in FIGS. 1–3, which are adapted for use with a rectangular shaped backboard.

FIG. 6 illustrates a basketball backboard and removable backboard cover combination 110. A fan-shaped backboard 111 is provided with a front face 112 and a back face 114 (not shown in FIG. 6). A rim 116 is attached to, and projects from, the front face 112. Preferably, a net 118 hangs from the rim 116. Releasably mounted on the backboard 111 is a removable cover 120. The removable cover 120 is provided with a central portion 122, which extends across the front face 112 of the backboard 111. The central portion 122 of the cover 120 is further provided with an opening 124 through which the rim 116 projects. Preferably, the cover 120 will further comprise a continuous peripheral edge 123, which extends across at least a potion of the continuous peripheral edge 111*a* of the fan-shaped backboard 111.

Preferably, the basketball backboard and removable backboard cover combination illustrated in FIG. 6 will display indicia 130 such as advertising promotional material across the central portion 122 of the cover 120. The indicia 130 may be as previously described. The cover 120 is preferably provided with a sleeve 134, which is constructed as discussed previously with respect to FIGS. 1 and 9.

As illustrated in FIGS. 7–8, the cover 120 is further provided with a leading edge portion 126, which extends across at least a portion of the back face 114 of the backboard 111. As illustrated in FIG. 7, the leading edge portion 126 of the cover 120 may be provided with a series of openings 142 through which a drawstring 140 is threaded. The perimeter of each opening 142 is preferably bordered by a metal washer 143. Preferably, the drawstring is provided with pinch cinches 144, which are adapted for snugly fitting the removable cover 120 on the backboard 111. The pinch cinches are constructed as previously described with respect to FIGS. 2*a–c* and are operated in the same fashion as previously discussed with reference to FIG. 2.

FIG. 8 illustrates yet another embodiment of the present invention wherein the leading edge portion 126 of the cover 120 is provided with a hollow channel 170 in which the drawstring 140 sits. Channel 170 may be formed as previously discussed with reference to FIG. 3. Moreover, the cover 120 depicted in FIG. 8 may be snugly fit on the backboard in essentially the same fashion as previously described with respect to FIG. 3.

Figure 10:
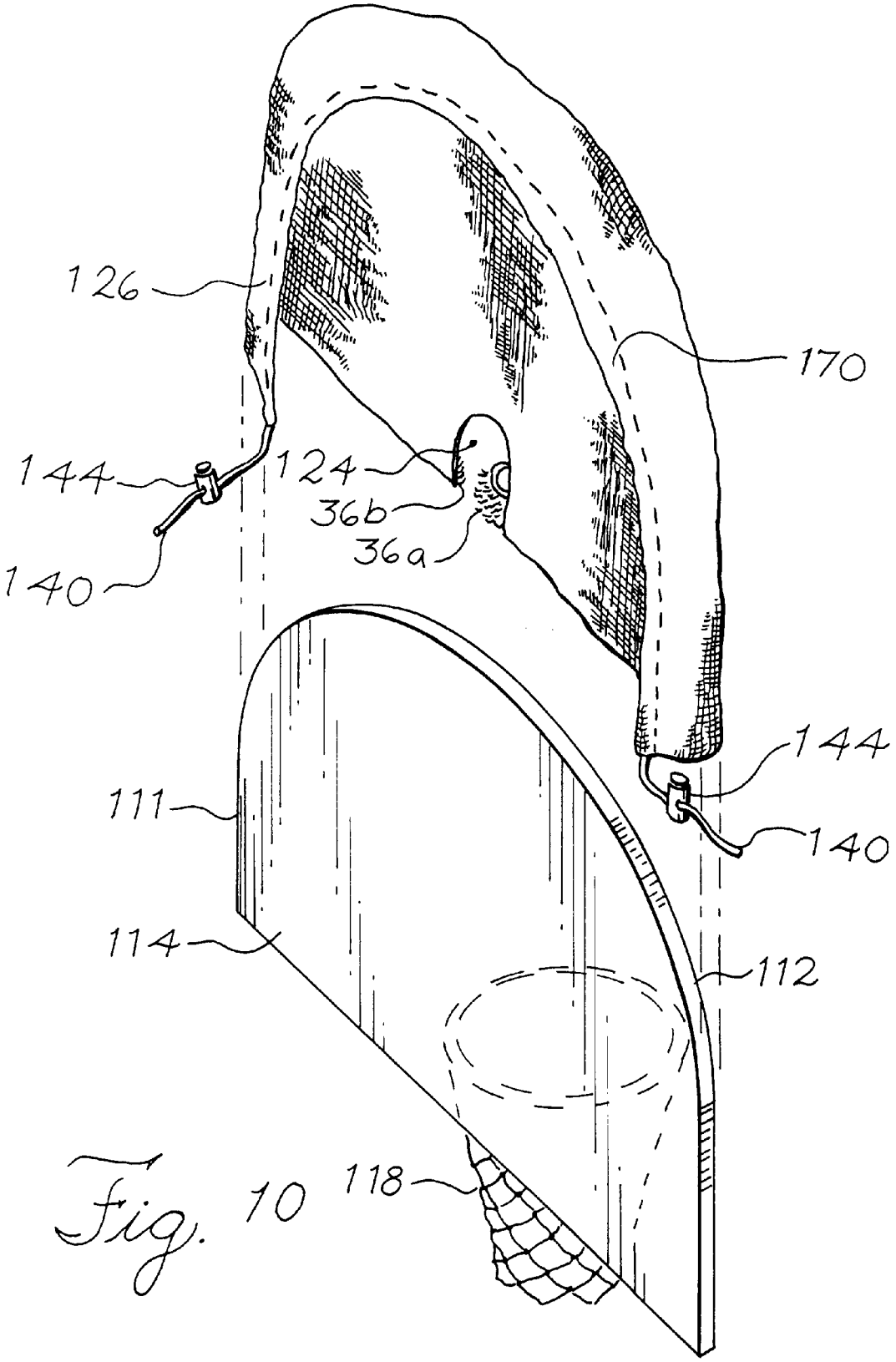
FIG. 10 is a perspective back view of a removable backboard cover according to one embodiment of the present invention in the process of being mounted on a fan-shaped basketball backboard.

FIGS. 9–10 illustrate the process of releasably mounting the cover 120 on the backboard 111. During mounting of cover 120 on backboard 111, sleeve 134 preferably in its open position for ease of mounting. Once the cover 120 is mounted on backboard 111, sleeve 34 is detachably secured by a hook and loop 136*a* and 136*b* such as VELCRO strip, which creates an opening 24 through which rim 16 projects. As mentioned above, those skilled in the art will appreciate that the present invention is not limited to the VELCRO strip arrangement 136*a* and 136*b* for detachably securing sleeve 134. Thus, for example, a snap or button arrangement may be used as a substitute for the VELCRO strip arrangement. Once mounted, central portion 122 of cover 120 will extend across front face 112 of backboard 111, and leading edge portion 126 of cover 120 will extend across a portion of back face 114 of backboard 111. The cover 120 can then be snugly fit on the backboard 111 by pulling drawstring 140 through pinch cinches 144 so as to reduce the amount of drawstring 140 in channel 170. In this manner, the central portion 122 of cover 120 can be made taut across the front face 112 of backboard 111.

As those skilled in the art will appreciate, the novel backboard cover disclosed herein may be embodied in forms other than those disclosed above without departing from the spirit or scope of the invention. The above-described embodiments are therefor to be considered in all respects as merely illustrative another restrictive. Thus, for example, the removable backboard cover may be specifically adapted for backboards that are mounted by specialized structural arrangements. Modifying the removable covers disclosed herein to accommodate backboards supported by specialized support structures is well within the ability of those of ordinary skill in the art. In short, the scope of the invention is defined by the appended claims rather than by the foregoing disclosure.

I claim:

1. A basketball backboard comprising a basketball backboard with a front face and a back face, the front face having an attached rim, and the back face having a series of snaps adapted to receive a series of complimentary snaps on a leading edge portion of a removable cover for the backboard.

2. A basketball backboard and removable backboard cover comprising:

(a) a basketball backboard comprising a front face and a back face, the front face having an attached rim;

(b) a removable backboard cover comprising an opening through which the rim of the front face of the backboard projects, the backboard cover extending across at least a portion of the front face of the backboard; and (c) securing means for removable securing the removable cover to the backboard.

3. A basketball backboard and removable backboard cover comprising:

(a) a basketball backboard comprising a front face and a back face, the front face having an attached rim, the backboard having a first securing part; and (b) a removable backboard cover comprising an opening through which the rim of the front face of the backboard projects, the backboard cover extending across at least a portion of the front face of the backboard and having a second securing part mateably secured with the first securing part of the backboard.

4. A combination of a basketball backboard and a removable backboard cover comprising:

(a) a basketball backboard comprising a front face and a back face, the front face having an attached rim; and (b) a removable backboard cover removable mounted on the backboard comprising a central portion and a leading edge portion, the central portion extending across the front face of the backboard and having an opening through which the rim of the front face of the backboard projects, and the leading edge portion extending across a portion of the back face of the backboard.

5. The combination of claim 4 wherein the central portion of the backboard cover includes indicia.

6. The combination of claim 5 further comprising a detachable sleeve positioned adjacent the opening of the central portion of the backboard cover.

7. The combination of claim 6 wherein the detachable sleeve comprises a hook and loop securing strip.

8. The combination of claim 6 wherein the detachable sleeve comprises a snap.

9. The combination of claim 6 wherein a drawstring extends along the length of the leading edge portion of the backboard cover, and at least a portion of the drawstring being manually accessible for snugly fitting the backboard cover on the backboard.

10. The combination of claim 9 wherein the drawstring is threaded through a series of holes extending along the length of the leading edge portion of the backboard cover.

11. The combination of claim 9 wherein the drawstring sits in a channel extending along the length of the leading edge portion of the backboard cover.

12. A combination of a basketball backboard and a removable backboard cover comprising:

(a) a basketball backboard comprising a front face and a back face, the front face having a rim attached thereto;

(b) a removable backboard cover comprising a central portion and a leading edge portion, the central portion extending across the front face of the backboard and displaying indicia, the central portion further having an opening located below the indicia through which the rim of the front face of the backboard projects and a detachable sleeve positioned adjacent the opening for ease of mounting the cover; the leading edge portion extending across a portion of the back face of the backboard, the leading edge portion having a drawstring extending along its length, a portion of the drawstring being manually accessible for snugly fitting the cover on the backboard.

13. A method of displaying advertising or other indicia on a basketball backboard comprising the steps of:

providing a removable backboard cover for the backboard, the cover comprising a central portion and a leading edge portion, the central portion comprising a display surface on which indicia is displayed and an opening adapted to permit a rim on a front face of the backboard to project therethrough, the central portion being dimensioned to extend across the front face of the backboard, and the leading edge portion dimensioned to extend across at least a portion of the back face of the backboard; and removably mounting the cover on the backboard so that the display surface of the central potion of the cover is exposed.

14. A method of displaying advertising or other indicia on a basketball backboard comprising the steps of:

providing a removable backboard cover adapted for mounting over the backboard, the cover comprising a central portion and a leading edge portion, the central portion comprising a display surface on which indicia is displayed and an opening adapted to permit a rim on a front face of the backboard to project therethrough, a detachable sleeve positioned adjacent the opening of the central portion for ease of mounting the cover, the leading edge portion dimensioned to extend across at least a portion of the back face of the backboard, the leading edge portion further having a drawstring extending along its length, a portion of the drawstring being manually accessible for snugly fitting the cover on the backboard; and removable mounting the cover on the backboard so that the display surface of the central portion of the cover is exposed.

* * * * *